US007168956B2

(12) United States Patent
Charnesky

(10) Patent No.: US 7,168,956 B2
(45) Date of Patent: Jan. 30, 2007

(54) SEVEN POINT WIRE HARNESS CONNECTOR

(75) Inventor: Scott P. Charnesky, Birmingham, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/131,041

(22) Filed: May 17, 2005

(65) Prior Publication Data

US 2006/0264071 A1 Nov. 23, 2006

(51) Int. Cl.
*H01R 33/00* (2006.01)
*H01R 13/73* (2006.01)

(52) U.S. Cl. ..... 439/35; 439/545

(58) Field of Classification Search ..... 439/34, 439/35, 131, 133, 135, 545; 293/126
See application file for complete search history.

(56) References Cited

U.S. PATENT DOCUMENTS 4,483,559 A * 11/1984 Lewis et al. ..... 293/126
5,288,094 A * 2/1994 Putnam ..... 280/420
5,549,478 A * 8/1996 McGuire ..... 439/35
5,611,695 A * 3/1997 Bentley ..... 439/35
6,007,346 A * 12/1999 Gutierrez et al. ..... 439/35
6,419,289 B1 * 7/2002 Batten et al. ..... 293/117
6,511,328 B2 * 1/2003 Molus et al. ..... 439/76.1
6,642,628 B2 * 11/2003 Burdick et al. ..... 307/9.1
2005/0037632 A1 * 2/2005 Ihde ..... 439/35

* cited by examiner

*Primary Examiner*—Hien Vu
(74) *Attorney, Agent, or Firm*—Laura C. Hargitt

(57) ABSTRACT

Methods and apparatus are provided for connecting wires from a primary vehicle to a towing vehicle through an improved wire harness connector. There is described an assembly of a vehicle bumper with a connector attached to the bumper. The bumper has a set of holes, snap-fit holes, and locking holes, that allow the connector to attach. The connector includes a set of snap-fits and at least one depressable lock. The snap-fits are configured so as to insert through snap-fit holes thereby restricting movement of the connector. The lock is also configured to pass through the locking hole thereby restricting movement of the connector.

15 Claims, 1 Drawing Sheet

SEVEN POINT WIRE HARNESS CONNECTOR

TECHNICAL FIELD

The present invention generally relates to a wire harness connector. More particularly, the present invention relates to a seven point wire harness connector for use with a trailer with brakes, and methods for attaching the connector to the towing vehicle.

BACKGROUND

A variety of vehicles exist that include, as part of their design, the ability to tow a trailer. By way of showing just a partial example, many trucks, SUVs, and other such vehicles exist that are designed to tow any number of trailers such as boat trailers, horse trailers, camping trailers, construction-related trailers, sports-related trailers, etc. When a vehicle such as a truck or SUV tows a trailer, it is also known to provide an electrical connection between the primary (towing) vehicle and the trailer. The electrical connection allows the trailer to indicate signals such as lights, brake signals, and turn signals that are provided by the primary vehicle. A seven point wire connector is known as one of several kinds of electrical/wire connection between the primary and towing vehicles.

Current designs of wire connectors typically include a receiving housing and a projecting housing. The receiving housing may be attached to the primary vehicle. Wire leads from the various electrical and signal functions of the primary vehicle are gathered in the receiving housing. A wire harness that collects these leads may be disposed in the housing. The receiving housing and projecting housing are designed such that they may be mechanically interconnected. Matching contacts positioned in the receiving housing and projecting housing are brought into electrical contact when the two parts are connected. Wire leads that are collected in the projecting housing proceed to lights or other functions in the trailer. Thus, signals from the primary vehicle are passed to the trailer.

There is an ongoing need to simplify the fabrication process of vehicles such as trucks and SUVs. Simplified constructions steps that eliminate unnecessary parts or construction steps reduce the time and cost of manufacture. Further, the elimination of redundant or unnecessary parts also saves weight on the vehicle. Even small improvements in weight and the manufacturing process are desired because, when accumulated with other such modifications, the economics and performance of the overall product can show measurable improvement. Thus, with respect to the current design of the seven point wire harness connector, it would be desired to streamline and improve its design and manufacture if possible.

Accordingly, it is desirable to simplify the design of the wire harness connector as currently used. In addition, it is desirable to eliminate any unnecessary parts and manufacturing steps that are currently used in the manufacture of the wire harness connector. Furthermore, other desirable features and characteristics of the present invention will become apparent from the subsequent detailed description and the appended claims, taken in conjunction with the accompanying drawings and the foregoing technical field and background.

BRIEF SUMMARY

An assembly is provided for use in providing an electrical connection from a vehicle having a bumper to a trailer attached to the vehicle. The assembly comprises a bumper attached to the vehicle. The bumper has a first side and a second side. The bumper also defines a number of snap-fit holes and at least one locking hole. The assembly also includes a connector having a number of snap-fits and at least one lock. The snap-fit may have a cap and stem which vary in thickness along at least one dimension. The snap-fit may be disposed within the snap-fit hole, thereby restricting movement of the connector with respect to the bumper. The lock may also be disposed within the locking hole thereby restricting movement of the connector.

A method is also provided for attaching a connector, suitable for use as a wire harness trailer connector, to a vehicle bumper. The method comprises the steps of providing a vehicle bumper having a first side and a second side with at least one snap-fit hole and a locking hold; positioning a connector, having at least one snap-fit and a depressable lock, against a first side of the bumper; pressing the connector against the first side of the bumper so that the snap-fit passes through the snap-fit hole of the bumper and so that the lock depresses against the first side of the bumper; sliding the connector so that the snap-fit moves within the snap-fit hole and so that the lock extends within the locking hole thereby attaching the connector to the bumper.

BRIEF DESCRIPTION OF THE DRAWINGS

The present invention will hereinafter be described in conjunction with the following drawing figures, wherein like numerals denote like elements whenever possible, and wherein.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Figure 1:
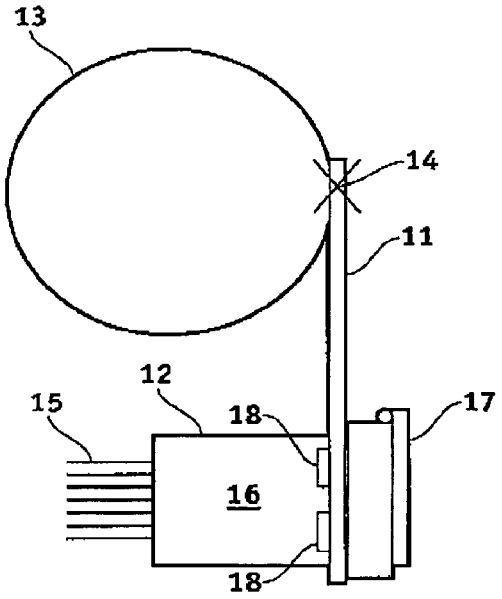
FIG. 1 is a side view illustration of a prior art means of attaching a prior art connector to a primary vehicle.

Referring now to FIG. 1 there is illustrated an embodiment of a conventional connector assembly affixed to a vehicle. Elements of the assembly include bracket 11, receiving connector 12, and hitch 13. Bracket 11 is welded to hitch 13 at weld point 14. Connector 12 itself comprises various elements including wires 15, housing 16, cover 17, and snap-fits 18.

In current practice, the assembly of connector 12 to a vehicle includes various steps relating to bracket 11. Bracket 11 must be manufactured, it must be positioned in a configuration relative to hitch 13, and bracket 11 must be welded to hitch 13. Further, the weld 14 must be such so that the relative position of bracket 11 and connector 12 are not unduly affected. Cumulatively, these steps are expensive and time consuming. It would be desired to eliminate or simplify them if possible.

Figure 2:
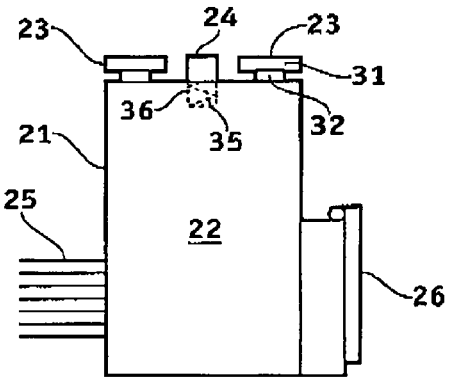
FIG. 2 is a side view of a connector according to an embodiment of the present invention.

Turning now to FIG. 2, there is shown a side view of a new receiving connector 21 (also referred to as a connector). Receiving connector 21 includes the elements of housing 22, snap-fits 23 (or snap-fit projections), lock 24, wires 25, and cover 26. It will be noted that several of the elements in receiving connector 21 are common with old receiving connector 12. However, the known elements have been rearranged. Additionally, as explained in further detail below, the method of attaching connector 21 to a vehicle have been modified. Thus receiving connector 21 comprises a new design configuration with respect to prior art connectors.

As is known in the art, housing 22 is preferably formed of a hardened thermoplastic. Injection molding is one method of manufacturing the housing. FIG. 2 illustrates housing 22 as being square or box-like in its profile view. Other shapes are possible. In one embodiment, housing 22 is cut away or provided with apertures in order to achieve a material savings. Preferably snap-fits 23 and housing 22 are formed of a unitary piece.

Still referring to FIG. 2, cover 26 may be mounted to housing 22 by a spring-loaded hinge. Cover 26 covers the opening of receiving connector 21 where a corresponding projecting connector would be inserted. Cover 26 also provides the function of protecting electrical contacts from exposure to rain, snow, debris, and other elements when connector 21 is not being used. A wire harness may be present within housing 22. Electrical contacts may be included within the harness, or otherwise disposed within housing 22. Preferably cover 26 protects exposed contacts. Additionally, features of connector 21 such as the contacts, harness and housing 22 may be configured so as to provide a seven point connector.

FIG. 2 illustrates a preferred embodiment of snap-fits 23. In this embodiment, each snap-fit 23 includes cap 31 and stem 32. Cap 31 of snap-fit 23 has a larger width, seen from the side view, than the stem 32 of the snap fit 23. However, as seen from the direction shown in FIG. 3, each snap-fit 23 has the same width, both cap 31 and stem 32. Thus, the width of each cap 31 is larger than the width of each stem 32 in a first dimension, and the length of each cap 31 is the same as the length of each stem 32 in a second dimension. As will be described later, this feature is useful in attaching connector 21 to a vehicle.

Lock 24, as shown in FIG. 2, is also useful in securing connector 21 to a vehicle. Preferably lock 24 is biased or spring loaded with a bias or spring 35. Lock 24 may be pushed down so that it recedes within a cavity 36 provided in housing 21. Upon releasing the compressive force from lock 24, it returns to its original, extended position. This too is useful in attaching connector 21 to a vehicle.

Figure 3:
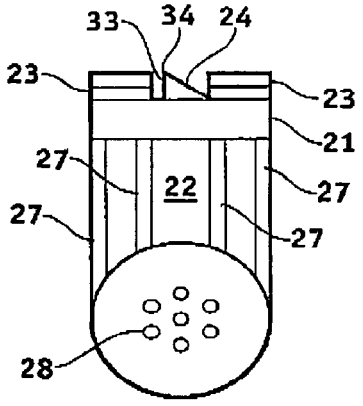
FIG. 3 is a front view of a connector according to an embodiment of the present invention.

Referring now to FIG. 3, there is shown a front view of new receiving connector 21. From this perspective there are shown additional features of connector 21, according to a preferred embodiment. Lock 24 is shown to have an angled or sloping top surface. The top surface of lock 24 is angled with respect to the top surface of housing 22 as shown in FIG. 3. Lock 24 thus has a triangular profile in the direction illustrated in FIG. 3. Further, stiffening ribs 27 are shown in FIG. 3, which are a preferred though optional element. In this embodiment, housing 22 is shown to have openings where material is absent. Thus stiffening ribs 27 act to brace the structure of housing 22. In the view of FIG. 3, cover 26 has been removed. The openings 28 are holes that would receive prongs from a projecting connector. Seven openings illustrate the connector 21 configured as a seven point connector. Additionally, FIG. 3 illustrates that snap-fits 23 have a constant profile from this perspective.

Figure 4:
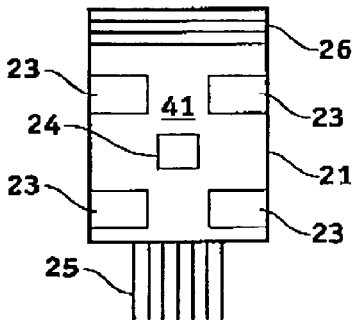
FIG. 4 is a top view of a connector according to an embodiment of the present invention.

Now turning to FIG. 4, there is shown a top view of new receiving connector 21. This illustrates how snap-fits 23, seen from above, are preferably square or rectilinear in shape. In this embodiment, snap-fits 23 are positioned on a top surface 41 of connector 21. Other configurations are possible.

Having described the new receiving connector 21 from a structural standpoint, a method of using the same will now be described.

The newly conceived receiving connector 21 is useful in that it has a simplified means of attachment to a vehicle. Whereas before the prior art connector 12 was attached to a bracket, now, the new receiving connector 21 attaches directly to a bumper surface of the vehicle. The need for a bracket 11, bracket weld 14, and the related positioning and manufacturing steps have been eliminated.

Figure 5:
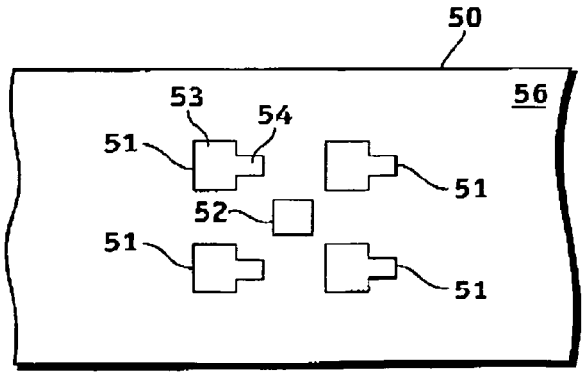
FIG. 5 is a plan view of a vehicle bumper with holes stamped therein for receiving a connector, according to an embodiment of the present invention.

In order to apply new receiving connector 21 to a vehicle, the vehicle must have a set of openings or holes in the bumper. Preferably, these holes are stamped in the bumper during its fabrication. Referring now to FIG. 5, there is shown one embodiment of a vehicle bumper with such openings. FIG. 5 illustrates a bumper 50. A conventional bumper 50 defines a first side 56 and second side, and FIG. 5 illustrates one such side 56. Snap-fit openings 51 appear in the bumper 50. Also, lock opening 52 appears in the bumper. It will be noted that each of snap-fit openings 51 comprises a larger area 53 and smaller area 54.

The bumper openings 51, 52 are shaped and positioned so as to match the position and contours of snap-fits 23 and lock 24 of connector 21. In particular, the larger area 53 of each snap-fit opening 51 should be shaped so as to allow cap 31 of each snap-fit 23 to pass therethrough. However, the smaller area 54 of each snap-fit opening 51 is shaped such that cap 31 cannot pass therethrough. The stem 32 of each snap-fit 23 can slide into the area defined by the smaller area 54 of snap-fit opening 51. Thus, in order to affix connector 21 to a vehicle, connector 21 is first brought into proximity with a first side of bumper 50. Snap-fits 23 fit within the area defined by the larger area 53 of each snap-fit opening 51. Thus connector 21 is moved such that cap 31 of snap-fits 23 pass through larger area 53 of each snap-fit opening 51. Connector 21 is moved until cap 31 extends beyond the opposite, or second, surface of bumper 50. Stem 32 of each snap-fit 23 should have sufficient height so as to allow cap 31 to extend above bumper 50. Doing this first brings lock 24 into contact with the first side of bumper 50. As connector 21 is further moved against bumper 50, the contact with bumper 50 depresses lock 24.

Once connector 21 is positioned against bumper 50 such that cap 31 of snap-fit 23 extends beyond the second surface of bumper 50, connector 21 is moved in a lateral position such that stem 32 of each snap-fit 23 passes into the area defined by smaller area 54 of snap-fit opening 51. By this movement, cap 31 of snap-fit 23 is moved away from larger area 53. Connector 21 is moved in the lateral direction until stem 32 reaches the end of motion permitted by the area defined by smaller area 54. Cap 31 cannot pass through smaller area 54. Thus, once connector 21 has moved such that cap 31 is positioned over smaller area 54 of snap-fit opening 51, connector 21 is restricted in its movement away from bumper 50.

Additionally, the lateral movement of connector 21 brings lock 24 into proximity with lock opening 52. Once lock 24, which has been depressed in a housing cavity due to contact with bumper 50, has reached a position under lock opening 52, lock 24 is allowed to rise to its normal position. By extending to its fully upright position, lock 24 engages with bumper 50 at the edge of lock opening 52. This action now restricts the movement of connector 21 such that it is affixed to bumper 50. Snap-fits 23 securely hold connector 21 against bumper 50 in snap-fit openings 51 because cap 32 cannot escape through the small area 54 of snap-fit opening, and lock 24, engaged with bumper 50 at lock opening 52 prohibits lateral movement.

It will be appreciated that connector 21 can be released from its attached position to bumper 50. Lock 24 can be depressed, as by manual action. Depressing lock 24 then allows connector 21 to make lateral movement. In a reversal of those movements that placed connector 21 in the affixed position, connector 21 can be slid laterally so that each cap 31 is moved from a position above small area 54 to a position above larger area 53. And, once each cap 31 is positioned above the larger area 53, connector 21 can be moved away from bumper 50 by drawing each cap 31 through larger area 53.

It will be recalled that in a preferred embodiment lock 24 has, in one profile, a triangular shape. Referring again to FIG. 3 the illustration shows lock 24 oriented in a way that will be termed directed toward the right side of the page. The triangle that represents lock 24 is situated such that the leg of the triangle is on the left side of the hypotenuse. Thus, a locking face 33 extends when lock 24 is extended. Lock also defines contact point 34. With this orientation, it is preferred that connector 21 be slid toward the right side of the page when engaging with bumper 50. In this manner, lock 24 slides in a manner such that lock 24 only contacts bumper 50 along contact point 34. The bulk of lock 24 is not in contact with bumper 50 thus allowing an easy sliding motion. Further, once lock 24 extends into lock opening 52, locking face 33 of lock 24 restricts movement of connector 21 in the lateral direction opposed to locking face 33.

Openings 51, 52 have been shown as generally rectilinear in certain portions. It will be appreciated that their size and shape may vary but must correspond to that of snap-fits 23 and lock 24.

The size and shape of housing 22, and the positioning of openings 51, 52, allows positioning of connector 21 in a desired location. Thus, for other design purposes it may be desired to have cover 26 in a given location when connector 21 is affixed to the primary vehicle. For example, the cover 26 should be positioned and aligned so as to allow easy mating of receiving connector 21 with a projecting connector. Thus, knowing a desired final location for cover 26 allows a designer to locate openings 51, 52 as well as to size housing 22 so as to allow this location.

A preferred configuration for connector 21 is illustrated by comparing FIG. 2 to FIG. 1. FIG. 2 illustrates the new receiving connector 21 having a housing 22 with several surfaces. The snap-fit projections 23 are disposed on a first surface of the housing 22; and the depressable lock 24 is also disposed on the same surface. The cover 26, however, defines a surface, a cover surface, that has an orientation approximately 90° to the surface where snap-fits 23 and lock 24 are located. This contrasts with the orientation of the prior art connector 12 in FIG. 1.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. An electrical assembly for use in providing an electrical connection from a vehicle having a bumper to a trailer attached to the vehicle comprising:

a bumper attached to the vehicle, the bumper having a plurality of snap-fit holes and at least one locking hole; and an electrical connector having a plurality of snap-fit projections each extending upwardly from a first face thereof and be disposed within one of the plurality of snap-fit holes, and at least one lock adapted to be disposed within the at least one locking hole to thereby restrict movement of the connector independently of the plurality of snap-projections, and a cover disposed on a second face oriented approximately 90 degree to the first face; wherein each snap-fit hole defines a larger area and a smaller area; wherein each snap-fit projection further comprising a stem and a cap.

2. The assembly according to claim 1 wherein each snap-fit cap is disposed over a smaller area of a snap-fit hole; and wherein each stem is disposed within a smaller area of a snap-fit hole.

3. The assembly according to claim 2 and wherein the width of each cap is larger than the width of each stem in a first dimension, and the length of each cap is the same as the length of each stem in a second dimension such that a stem may move within a smaller area of a snap-fit hole but a cap may not.

4. The assembly according to claim 1 wherein the connector comprises injection molded thermoplastic.

5. The assembly according to claim 1 further comprising a wire harness, the wire harness disposed within the connector so as to allow electrical contact.

6. The assembly according to claim 1 wherein the connector is configured so as to comprise a seven point connector.

7. The assembly according to claim 1 wherein the lock is triangular in one profile so as to define a locking face and a contact point.

8. The assembly according to claim 1 wherein the connector comprises four snap-fits.

9. An electrical connector, suitable for use as a receiving wire harness trailer connector, comprising:

a housing having a plurality of surfaces;

a plurality of snap-fit projections disposed and extended upwardly from a first surface of the housing;

a depressible lock disposed on the first surface of the housing;

a cover disposed on the housing so as to define a cover surface for covering holes that receive prongs from a mating connector; and wherein the first surface of the housing and the cover surface of the housing are oriented at approximately 90° to each other;

wherein each snap-fit projection comprises a cap and a stem.

10. The connector according to claim 9 wherein the housing and the snap-fit are a unitary injection molded thermoplastic piece.

11. The connector according to claim 9 wherein a seven wire harness is disposed within said connector housing.

12. The connector according to claim 9 wherein said housing further comprises at least one stiffener.

13. The connector according to claim 9 wherein said cover is hingeably mounted to said housing.

14. The connector according to claim 9 wherein the depressible lock includes a biasing spring that tends to keep lock in an extended position, and wherein the housing includes a cavity into which the lock moves when depressed.

15. The connector according to claim 9 wherein the width of each cap is larger than the width of each stem in a first dimension and the length of each cap is the same as the length of each stem in a second dimension.

* * * * *